US005565966A

United States Patent [19]

Ochiai et al.

[11] Patent Number: 5,565,966

[45] Date of Patent: Oct. 15, 1996

[54] IMAGE FORMING METHOD FOR SETTING A DEVELOPING GAP

[75] Inventors: Masahisa Ochiai, Fukaya; Toshihiko Noshiro; Masumi Asanae, both of Kumagaya, all of Japan

[73] Assignee: Hitachi Metals, Ltd., Tokyo, Japan

[21] Appl. No.: 443,403

[22] Filed: May 17, 1995

[30] Foreign Application Priority Data

May 19, 1994 [JP] Japan ..... 6-129766

[51] Int. Cl.[6] ..... G03G 13/09; G03G 15/09

[52] U.S. Cl. ..... 355/251; 118/657; 430/122

[58] Field of Search ..... 355/251; 118/657, 118/658; 430/122

[56] References Cited

U.S. PATENT DOCUMENTS

| | | | |
|---|---|---|---|
| 4,292,387 | 9/1981 | Kanbe et al. | 118/657 X |
| 4,699,865 | 10/1987 | Mitsuhashi | 430/122 X |
| 4,841,332 | 6/1989 | Haneda et al. | 355/251 |
| 5,217,835 | 6/1993 | Watanabe et al. | 430/122 X |
| 5,348,829 | 9/1994 | Uchiyama et al. | 430/122 X |
| 5,424,812 | 6/1995 | Kemmochi et al. | 355/251 |

FOREIGN PATENT DOCUMENTS

| | | |
|---|---|---|
| 59-226367 | 12/1984 | Japan . |
| 62-201463 | 9/1987 | Japan . |
| 63-35984 | 7/1988 | Japan . |
| 63-223675 | 9/1988 | Japan . |
| 3-138674 | 6/1991 | Japan . |
| 3-182782 | 8/1991 | Japan . |
| 2150465 | 7/1985 | United Kingdom . |

*Primary Examiner*—Arthur T. Grimley
*Assistant Examiner*—Sophia S. Chen
*Attorney, Agent, or Firm*—Morgan, Lewis and Bockius LLP

[57] ABSTRACT

A sleeveless magnet roller is formed of at least magnetic powder and resin. It is so arranged that, letting a developing gap Ds be the gap between an image-bearing member for holding an electrostatic latent image and a developer conveying member and a doctor gap Dg be the gap between the developer conveying member and a developer's thickness regulating member, one obtains Ds–Dg=0.1 to 0.3 (mm) and Dg=0 to 0.4 (mm). For image formation, one- or two-component magnetic developer is used and a bias voltage, formed by superimposing AC bias voltage to DC bias voltage, is applied to the developing region.

9 Claims, 2 Drawing Sheets

IMAGE FORMING METHOD FOR SETTING A DEVELOPING GAP

BACKGROUND OF THE INVENTION

1. Field of the Invention

The present invention refers to an image forming method by a non-contact development using a sleeveless magnet roller as a developer conveying member.

2. Description of the Related Art

For conventional copiers, printers, or facsimile terminal equipment, image forming apparatus using the electrophotography process or the electrostatic recording process is widely known. Generally, according to these processes, a developer is supplied to the developing region between an image-bearing member and a developer conveying member opposed to each other by using the developer conveying member. By causing toner in a developer to deposit to an electrostatic latent image formed on the surface of image-bearing member with an optical image exposure, an image forming is carried out.

The main part of the developer conveying member is a magnet for conveying a developer formed on the roller, on whose surface a sleeve made of non-magnetic materials is provided. The above roller-shaped magnet (hereinafter referred to as a magnet roller) has a plurality of magnetic poles on the surface and a sleeve covers the surface of the magnet in such a manner as to be rotatable to each other.

Also on the surface of the sleeve, a developer thickness regulating member (hereinafter referred to as doctor blade) for regulating the developer layer held on the surface of said sleeve to be constant in thickness is oppositely placed.

The developer is allowed to pass through a small gap (hereinafter referred to as doctor gap: Dg) between the surface of the sleeve and the doctor blade while magnetically adsorbed and held to the surface of the sleeve, so that a thin layer of developer is formed at a predetermined thickness and conveyed to the developing region in which the magnet roller and the image-bearing member are oppositely placed.

In recent years, for this type of image forming apparatus, not only an improvement in image quality but also the low-cost downsizing is strongly required. To meet such a request, various proposals are made for developing apparatus. For example, the development of electrostatic latent images using a magnet roller without a sleeve provided on the surface of the magnet, what is called, a sleeveless magnet roller, has been proposed (e.g. GB2150465A, Japanese Patent Laid-Open Publication No. 223675/1988, and Japanese Patent Laid-Open Publication No. 201463/1987).

To save the production cost, a sleeveless magnet roller is often produced using resin (including elastic materials such as rubber) through injection molding or the like. According to such a sleeveless magnet roller, it is said that no sufficient triboelectrostatic charge of toner in the developer is performed and the image quality is poor.

Accordingly, it is also proposed that a fine electrode for toner attraction is provided on the surface of the sleeveless magnet roller, but to newly install a fine electrode needs labor and so goes against the object of cost-saving and downsizing by using a sleeveless magnetic roller.

Consequently, a proposition is also seen in which electrically conductiveness of the surface of a magnet roller enables a bias to be applied to a developer (Japanese Patent Laid-Open Publication No. 201463/1987). However, this proposition is better in cost than the case of installing a fine electrode, but no sufficient triboelectrostatic charge can yet be accomplished. Thus, there is a problem in that scattering of toner from a magnetic roller rotating at a high speed makes the background fog likely to occur.

On the other hand, various attempts are made also on the opposing relation between an image-bearing member and a magnet roller in the developing region.

In what is called a magnetic brush development in which latent images on the surface of an image-bearing member are rubbed by using a magnetic brush comprising developer layer whose thickness is controlled with a doctor blade, a contact development process having a small gap (developing gap: Ds, e.g., about 0.5 mm) provided between the image-bearing member and the surface of a magnet roller is known. On the other hand, another contact development process is also proposed in which what is called a soft magnetic roller made of softer materials than an image-bearing member is provided in contact with the surface of the image-bearing member.

In the above method, however, because the developing gap is small, developer is likely to deposit to a portion other than the latent image ones and the occurrence of background fog presents a problem. In addition, fluidity is required for developer to be used, for example, it is known that when fluidity reduces due to a change in humidity and other causes, developer sticks or the like fast to the portion of the doctor blade, thus causing a bad effect on the image quality. To solve such problems, still another method called a jumping development, or non-contact development, has been proposed in which a wider gap of developing than the conventional is set and developer is made to jump from the surface of the magnet roller to the surface of the image-bearing member.

On the basis of these various attempts, a non-contact development process using a sleeveless magnet roller low in forming cost is considered from the standpoint of attaining the cost-saving and downsizing and preventing the occurrence of background fog in image quality. In this type of conventional process, however, a problem is pointed out that the insufficient triboelectrostatic charge of developer allows developer to scatter from the surface of the speedily rotating magnet roller, thereby causing the background fog to appear in spite of a noncontact development.

SUMMARY OF THE INVENTION

From a consideration of these problems, it is an object of the present invention to provide an image forming method with non-contact development in which a background fog is prevented by using a sleeveless magnet roller excellent in the adsorptive holding of a developer.

According to the present invention, an image forming method comprises: forming a developing region by placing a developer conveying member opposite an image-bearing member for holding an electrostatic latent image; regulating the thickness of a magnetic developer with the thickness regulating member disposed opposite said developer conveying member; conveying a magnetic developer held on the surface of the developer conveying member to the developing region; and visualizing an electrostatic latent image by applying a developing bias voltage to the developing region; and wherein using as said developer conveying member, a magnet in the form of a cylindrical permanent magnet composed at least of magnetic powder and resin and having a plurality of magnetic poles with heteropolar magnetic poles alternately disposed in the circumferential direction on the surface, setting said developer conveying member opposite to the image-bearing member through a developing gap (Ds) larger than the thickness of magnetic developer, regulated with said thickness regulating member, setting Ds–Dg=0.1 to 0.3 (mm) when Dg (doctor gap) is the gap between said thickness regulating member and the surface of said developer conveying member, and applying AC bias voltage superimposed to DC bias voltage as said developing bias voltage. Furthermore, the doctor gap Dg is set to Dg=0 to 0.4 (mm).

Also, as the developing bias voltage, AC voltage of a peak-to-peak value of 200 to 2400V and a frequency of 100 Hz to 20 kHz (preferable a low-frequency less than 10 kHz) superimposed to −200 to −600 V of DC voltage is applied.

And, the cylindrical permanent magnet contains 50 to 95 wt % of magnetic powder.

On the other hand, by setting Dg within the range between 0 to 0.4 mm, the present invention can correspond to a two-component developer containing carriers of relatively large average particle size compared to the toner.

The reason for setting Dg above 0 is that even bringing a doctor blade in contact with the surface of the magnet roller permits a sufficiently thin developer layer to be obtained in a one-component developer comprising particle size toner. And, for Dg above 0.4 mm, the thickness of a developer layer formed becomes too large and scattering of the surface layer portions, leading to occurrence of background fog, becomes likely to occur.

The reason for setting Ds–Dg within the range between 0.1 to 0.3 mm is that the surface layer portion of the developer layer on the surface of the magnet roller deposit to a non-image area of a latent image and background fog occurs for Ds–Dg below 0.1 mm whereas, for Ds–Dg above 0.3 mm, developer does not effectively move to the surface of the image-bearing member and the density of images falls. Furthermore, a value of DC voltage in said developmental gap is set within the range between −200 to −600V to obtain an appropriate density of images due to the fact that neither too great nor too small quantity of developer moves from the developer conveying member to the image-bearing member. In addition, the reason for setting a peak-to-peak value at 100 Hz to 20 kHz of AC bias voltage at 200 to 2400V is enabling an excess of developer deposited also to a non-image area of a latent image on the surface of the image-bearing member by the applying of said DC bias voltage to be called back to the developer conveying member neither too great nor too small an extent which causes no decrease in the density of images.

Meanwhile, the reason for determining the cylindrical permanent magnet to contain 50 to 95 wt % of magnetic powder is that no appropriate magnetic force (magnetic flux density of the surface of the magnet) can be given to the developer conveying member if below 50 wt % and the formability is poor if above 95 wt %.

In the invention mentioned above, since a cylindrical permanent magnet composed of at least magnetic powder and resin in which heteropolar magnetic poles are alternately provided in the circumferential direction is used as a developer conveying member, resin magnets of low forming cost are available as it is, so that the cost saving and downsizing of an image forming apparatus can be achieved. On the other hand, since developer is magnetically adsorbed to the surface of the developer conveying member, the scattering of developer can be prevented even if no sufficient electrification is accomplished to developer owing to the use of resin.

By determining the developing gap between the image-bearing member and the developer conveying member to be controlled with the thickness regulating member as larger than the thickness of developer, that is, adopting, what is called, a non-contact development, the background fog due to the deposition of developer on a non-image area of a latent image can be effectively prevented from occurring.

By controlling Dg to be within a predetermined range, the thickness of a developer layer formed can be suppressed in such a degree to eliminate the scattering of the surface portion of the developer layer. Furthermore, by controlling the range of Ds–Dg also, not only an excessive deposition of developer to a non-image area of a latent image by rubbing a developer on the developer conveying member can be prevented but also an appropriate density of images can be obtained.

Furthermore, by applying AC bias voltage to DC bias voltage, superimposed, an excess of toner deposited to a non-image area of a latent image is moved to the developer conveying member, so that the background fog can be more effectively prevented in addition to the effect mentioned above of the non-contact development.

DESCRIPTION OF THE PREFERRED EMBODIMENTS

[Embodiment 1]

Figure 1:
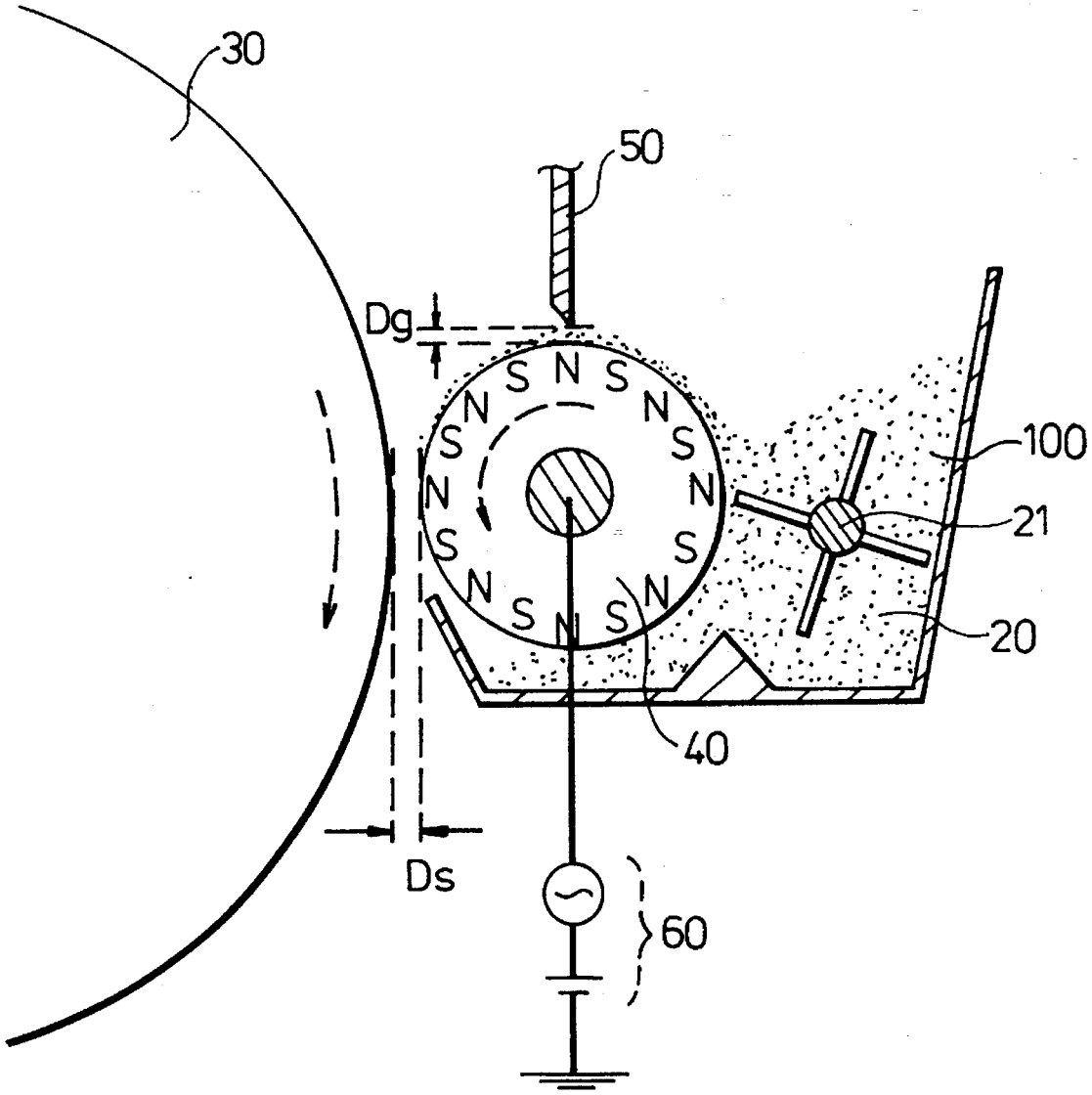
FIG. 1 is a schematic diagram illustrating the main constituent of an image forming apparatus to be used in the embodiment 1.

FIG. 1 schematically illustrates the main constituent of an image forming apparatus to be used in the embodiment 1. The image forming apparatus has a sleeveless magnet roller 40 as developer conveying member provided in such a manner as to be rotatable at a high speed in the hopper-shaped developer container 20 for retaining developer 100. The sleeveless magnet roller 40 is placed opposite the image-bearing member 30 in such a manner as to form a developing region and a distance between the surface of the sleeveless magnet roller 40 and that of the image-bearing member 30 is set at a predetermined developing gap Ds.

On the other hand, on the surface of the sleeveless magnet roller 40, a doctor blade 50 as member for controlling the thickness of developer 100 is oppositely provided, and the gap between the doctor blade 50 and the surface of the sleeveless magnet roller 40 is set at a predetermined doctor gap Dg. And, the sleeveless magnet roller 40 is connected to the bias power supply 60 for applying an AC bias voltage to a DC bias voltage, superimposed, in such a manner as that a bias voltage is applied to the developing region.

The doctor blade 50 is kept not to contact against, or doctor gap Dg apart from, the surface of the sleeveless magnet roll 40 as shown in FIG. 1, but may be kept to press contact against the sleeveless magnet roll 40 by using an elastic blade.

Furthermore, in the developer container 20, a stirring roller 21 for stirring a developer is provided. Also, around the image-bearing member 30, charger, optical image exposure and the like (none of them is shown) are provided so that an electrostatic latent image can be formed on the surface of the image-bearing member 30. And, with a developer conveyed to a developing region by means of the sleeveless magnet roller 40, an electrostatic latent image on the image-bearing member 30 is visualized.

The above sleeveless magnet roller 40 is an isotropic resin magnet (plastic magnet, rubber magnet and the like) comprising alternate N-poles and S-poles (elongated axially) symmetrically disposed in the circumferential direction on the surface. As the magnet roller, roll-shaped one formed of these magnetic poles on a shaft or one integrally formed of magnetic materials including a shaft as a whole is available.

The sleeveless magnet roller 40 to be used in the present invention is obtained by kneading a raw material in which magnetic powder (e.g., ferrite powder or ferromagnetic powder of rare earth magnets), sulphur, and vulcanization accelerator, further conductive agents (e.g., carbon black and carbon fiber) according to the need, are added to a rubber material (e.g., urethane rubber, silicone rubber, and butyl rubber), followed by casting, vulcanization, outer grinding, and magnetizing. In addition, for the present invention, an isotropic magnet roller is also available which is made up by projecting or extruding a kneaded material mainly comprising thermoplastic resin (polyamide, ethylene vinyl acetate copolymer, ethylene ethyl acrylate copolymer, or the like) and magnetic power (preferably 50 to 90 wt %).

The sleeveless magnet roller 40 according to the present invention is a roll-shaped one formed on a shaft as 32 poles symmetrically magnetized, 20 mm in outside diameter and 150G in surface magnetic flux density, where the urethane rubber content is 20 weight parts and the magnetic powder content (Sr ferrite powder, 1.0 μm in average grain size) is 80 weight parts from a consideration of formability.

Incidentally, from a consideration of formability and magnetic characteristics in a sleeveless magnet roller 40, the magnetic powder content is preferably within the range between 50 to 90 wt %.

On the other hand, the developer to be used in the present embodiment 1 may be either one-component developer or two-component developer so long as it is a magnetic developer.

One-component developer comprising magnetic toner is prepared as follows:

Dry-blend 55 weight parts of styrene-n-butyl methacrylate copolymer (weight average molecular weight: about 210,000; number average molecular weight: about 16,000) as binder resin, 40 weight parts of magnetite (Toda Kogyo Corporation, EPT500) as magnetic powder, 3 weight parts of polypropylene (Sanyo chemical Co. Ltd., TP32) as release agent, and 2 weight parts of charging-controlling agent (Orient chemical Industries, Bontron S34) by means of a mixer. Then, knead the blend on heating, harden it on cooling, and pulverize it by using a jet mill, rotor stator pulverizer, or the like. After pulverization and classification, magnetic toner, $5\times10^{14}$ Ω·cm in volume resistivity, −24 μC/g in triboelectrostatic charge and 9.0 μm in volume average particle size, is obtained.

The volume resistivity of the above magnetic toner and the below carrier, and the triboelectrostatic charge of toner are measured as follows: Measurement of volume resistivity is made on 10 and several mg of sample filled in a TEFLON (trade name) cylinder, 3.05 mm in inside diameter, on applying a load of 100 g·f under an electric field of DC 4000V/cm (DC 200V/cm for carrier). Measurement of triboelectrostatic charge is made at a 5% concentration of toner (ferrite carrier (HITACHI Metals, Ltd., KBN-100) is used as standard carrier) by using a commercially available triboelectrostatic charge measuring device (Toshiba Chemical Inc., model TB-200). Measurement of average particle size for toner is made by using a particle size analyzer (Coal Tar Electronics Co., Ltd., Coal Tar Counter Model TA-II).

As two-component developer, either a combination of carrier and non-magnetic toner or a combination of carrier and magnetic toner may by used, where the average particle size is preferably 5 to 10 μm. Furthermore, insulating developer (volume resistivity above $10^{13}$ Ω·cm) is preferred and those likely to be triboelecrostatically charge due to the contact with a doctor blade or carrier and so on (triboelectrostatic charge is desirably above 5 μc/g in absolute value) are preferable. Toner comprises binder resin (styrene-acryl copolymer, polyester resin or the like) and colorant (carbon black, rose bengal, aniline blue or the like; however unnecessary when using black magnetic powder represented by magnetite as magnetic powder) as indispensable constituents, and magnetic powder (magnetite, soft ferrite or the like), charge-controlling agent (nigrosine dye, metal-containing azo dye or the like), release agent (polyolefin or the like) and fluidizer (hydrophobic silica or the like) as optional constituents. In the case of magnetic toner, preferably, 20 to 60 wt % of magnetic powder is contained and further a small quantity (below 1 wt %) of fluidizer is added.

The above magnetic toner can be singly used, but may be mixed with magnetic carrier (soft ferrite, iron powder, magnetite, or the like), where the concentration of toner need only be selected within the range between 10 to 90 wt % (preferably 10 to 60 wt %). The above non-magnetic toner, mixed with magnetic carrier, is used, where the concentration of toner needs only be selected within the range between 5 to 60 wt %.

The above magnetic carrier is 5 to 100 μm in average particle size and it is preferable to use magnetic particles that exhibit a magnetization of more than 50 emu/g in a magnetic field of 1000 Oe. The average particle size of carrier ranges preferably from 10 to 50 μm. That is, for the average particle size not greater than 50 μm, a sufficient triboelectrostatic charge can be given to toner. While toner becomes unlikely to scatter from a magnet for the average particle size not less than 10 μm.

In the present embodiment, 3 types of two-component developer were prepared by combining the toner of the above composition with the following three types of carrier.

As ferrite carrier, Ba-Ni-Zn ferrite carrier (HITACHI Metals, Ltd., KBN-100), 88 to 105 μm in average particle size and $10^8$ Ω·cm in volume resistivity was used.

As magnetic carrier (volume resistivity: $10^8$ Ω·cm) using magnetite, carrier exhibiting a particle size distribution of 37 to 74 μm and an average of 50 μm was obtained by mixing 1 weight part of silicone resin for surface coating into 100 weight parts of magnetite (HITACHI Metal Industries, Ltd., KMC-1) by means of a mixer, cooling the mixture after heat treatment, and classifying it.

Also, as iron carrier (volume resistivity: $10^7$ Ω·cm), carrier, 10 to 50 μm in particle size, was obtained by mixing 1 weight part of silicone resin for surface coating into 100 weight parts of flat-shaped iron powder (HITACHI Metals Ltd., KTC) by means of mixer and cooling the mixture after heat treatment. In this way, a two-component developer was prepared by mixing the above 3 types of carriers and the above magnetic toner at a toner concentration of 50 wt %.

On the other hand, non-magnetic toner was prepared as follows: Mix 85 weight parts of styrene-acryl copolymer (above described), 10 weight parts of carbon black (Mitsubishi Kasei Corp., #50), 3 weight parts of polypropylene (Sanyo chemical Co. Ltd., TP32), and 2 weight parts of charge-controlling agent (Orient chemical Industries, Bontron S34) in dryness by means of a mixer, then cool and harden the mixture after kneading on heating. Furthermore, after pulverization and classification, a non-magnetic toner, 8.5 μm in volume average particle size, $2\times10^{14}$ Ω·cm in volume resistivity, and −27 μC/g in triboelectrostatic charge was obtained. This toner was mixed with carrier to form a developer with toner concentration of 30 wt %.

Thereafter, using the one-component and two-component developers of the above compositions, images were obtained on an image forming apparatus of said constitution and the estimation of images was performed.

In the case, forming a developing region by placing a developer conveying member (peripheral speed of 100 mm/sec) opposite an image-bearing member (OPC, peripheral speed of 25 mm/sec) for holding an electrostatic latent image (surface potential of unexposed area is −550V), regulating the thickness of a magnetic developer with the thickness regulating member disposed opposite said developer conveying member, conveying a magnetic developer held on the surface of the developer conveying member to the developing region, and visualizing an electrostatic latent image by applying a developing bias voltage to the developing region for reversal development. In experiments, images were obtained for various values of developing gap Ds and doctor gap Dg and different values of bias voltage applied to the developing region, table 1 shows the obtained results.

may be employed as resin for the sleeveless magnet roller 40.

Figure 2:
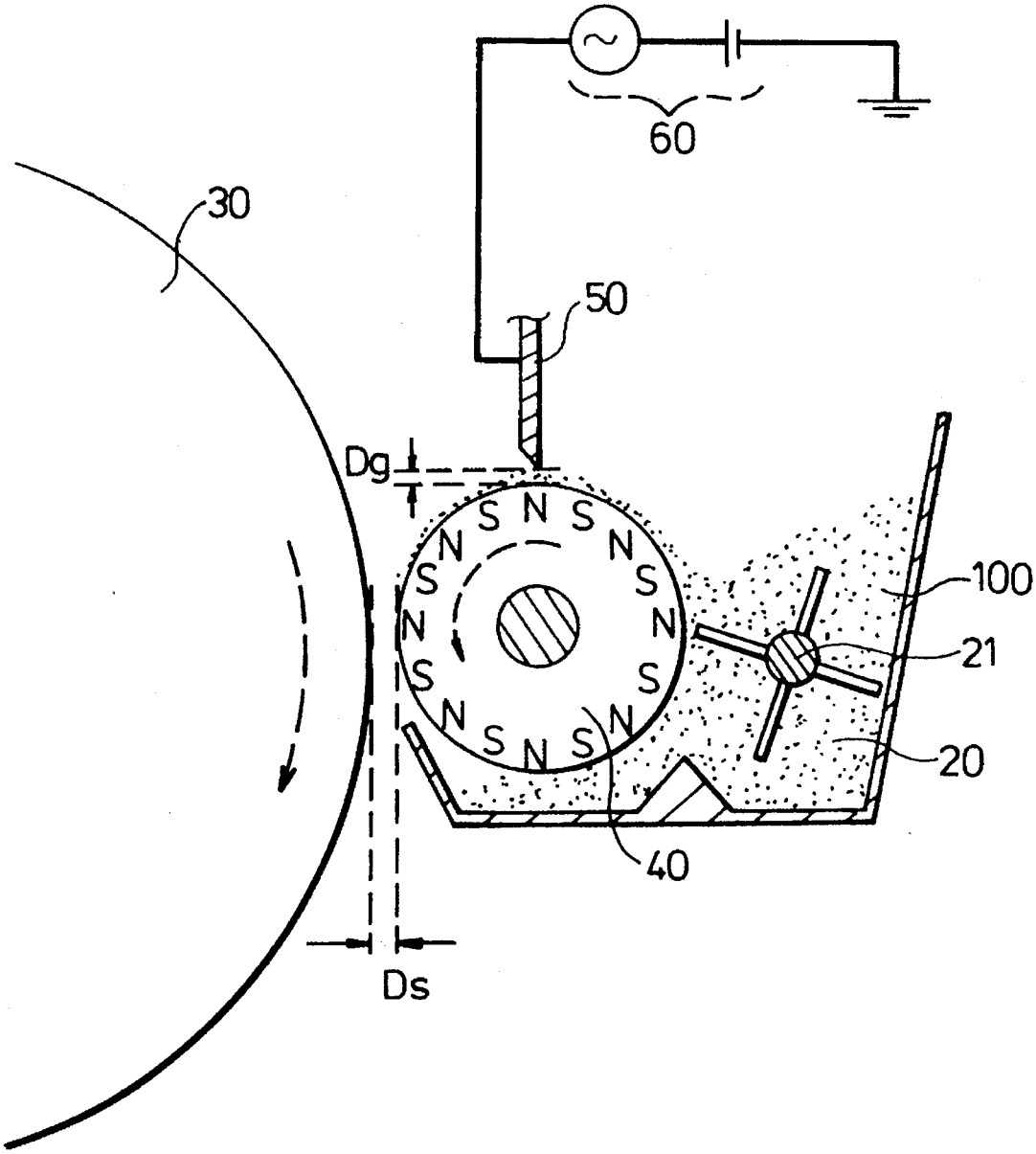
FIG. 2 is a schematic diagram illustrating the main constituent of an image forming apparatus to be used in the embodiment 2.

Thus, in the embodiment 2, since the sleeveless magnet roller 40 is insulating (volume resistivity: $10^9$ Ω·cm), it is arranged to apply a bias voltage through a doctor blade 50 rather than through the sleeveless magnet roller 40. Accordingly, the doctor blade (made of brass) 50 is connected to a bias power supply 60 for AC voltage superimposed to DC voltage so that a bias voltage may be applied to the developing region. As the above, the image forming apparatus of FIG. 2 is different in the connection of the bias power supply 60 from the apparatus of FIG. 1, but other constituent of the apparatus of FIG. 2 is similar to that of FIG. 1.

Furthermore, as the developer to be used in the embodiment 2, one-component developer comprising magnetic toner and two-component developer comprising a combination of magnetic or non-magnetic toner and carrier were used.

Much the same magnetic toner and non-magnetic toner were used as with the embodiment 1, but the content of magnetic powder in the magnetic toner was modified to be 50 weight parts and 25 weight parts in usage. The contents of charge-controlling agent and release agent was not modified, but the content of binder resin was modified for preparation so that the total amount including magnetic powder may be the same as with the embodiment 1.

On the other hand, as carrier, Cu-Zn ferrite carrier (average grain size: 40 μm; volume resistivity: $10^7$ Ω·cm) and iron carrier (grain size less than 37 μm; average grain size: 25 μm) were prepared in accordance with the method of the embodiment 1.

TABLE 1

| | Developer | | Gap | | Applied voltage: Direct current | Applied voltage: Alternating current | | Image quality | |
|---|---|---|---|---|---|---|---|---|---|
| No. | Toner | Carrier | Dg (mm) | Ds (mm) | DC (V) | AC ($V_{p-p}$) | Hz | Image density | Fog density |
| 1 | Magnetic toner | — | 0 | 0.2 | −500 | 1200 | 1k | 1.37 | 0.08 |
| 2 | Magnetic toner | — | 0.3 | 0.5 | −500 | 1600 | 200 | 1.35 | 0.07 |
| 3 | Magnetic toner | Ferrite | 0.3 | 0.6 | −400 | 2000 | 2k | 1.40 | 0.10 |
| 4 | Magnetic toner | Magnetite | 0.2 | 0.4 | −400 | 2000 | 100 | 1.41 | 0.08 |
| 5 | Magnetic toner | Flat-shaped iron powder | 0.2 | 0.5 | −500 | 800 | 1k | 1.38 | 0.07 |
| 6 | Non-magnetic toner | Flat-shaped iron powder | 0.2 | 0.3 | −500 | 1600 | 200 | 1.38 | 0.08 |

Herein, the content of magnetic powder in a magnetic toner is 40 wt %.

[Embodiment 2]

FIG. 2 schematically illustrates the main constituent of an image forming apparatus to be used in the embodiment 2.

The sleeveless magnet roller 40 to be used in the embodiment 2 is a magnet roller with 32 poles symmetrically fitted, obtained by kneading and projecting a compound in which a 90:10 ratio of isotropic Ba ferrite powder as magnetic power and nylon-6 are mixed, whose surface magnetic flux density is 200G. Besides nylon resin mentioned above, polyurethane resin, ethylene ethyl acrylate resin and the like, or plastic having some elasticity to exert no stress on toner Otherwise, values of Dg, Ds, and applied voltage were modified in a similar way to that of the embodiment 1, and images were obtained in the same condition with the embodiment 1 by using the developers of the above composition and the image forming apparatus of the above constitution. Table 2 shows the estimation of images.

TABLE 2

| | | | | | Applied voltage | | | | | |
|---|---|---|---|---|---|---|---|---|---|---|
| | | | Gap | | Direct | Alternating current | | Image quality | | |
| | developer | | Dg | Ds | current | AC | | Image | Fog | 5K |
| No. | Toner | Carrier | (mm) | (mm) | DC (V) | ($V_{p-p}$) | Hz | density | density | page |
| 1 | Magnetic toner 50 wt % | — | 0.1 | 0.3 | −400 | 1200 | 200 | 1.35 | 0.07 | o |
| 2 | Magnetic toner 25 wt % | Iron powder | 0.2 | 0.5 | −500 | 2400 | 500 | 1.38 | 0.09 | o |
| 3 | Non-magnetic toner | Ferrite | 0.3 | 0.5 | −400 | 1600 | 2k | 1.40 | 0.09 | o |

(Comparative Example 1)

In comparative example 1, using a magnet roller (asymmetric 4 poles, developing magnetic pole exhibits 750G on the sleeve) provided with a SUS 304 sleeve of 20 mm outer diameter [blast processing by using alundum particles; 1.0 μm (Rz) in surface roughness (peripheral speed of 100 mm/sec)], images were formed by non-contact development process in a similar way to the embodiment 2 and the estimation of images were performed. As developer, one-component developer composed of magnetic toner used in the embodiment 1 was used.

(Comparative Example 2)

In the comparative example 2, using a rubber roller in which no magnetic powder is kneaded into the magnetic roller, images were obtained by non-contact development process in a similar way to the above embodiment 2 and the estimation of images were performed. As developer, one-component developer composed of non-magnetic toner used in the above embodiment 2 was used. Table 3 shows the estimation of images in the above controls 1 and 2 together.

On the other hand, Table 2 also shows a good result obtained like Table 1 though the composition of developer varies somewhat. Furthermore, a series of 5000 sheet images was formed under the conditions of Tables 1 and 2 and all images obtained shows that the image density is good, no appearance of white stripes and other defects is seen, and a good image quality is maintained.

In the comparative example 1 of Table 3, the estimation of images was performed using a conventional sleeve magnet roller enabling a good triboelectrostatic charge and a series of 5000 sheet printing showed a decrease in image density. This is attributable to the wear of projections by blast processing provided on the surface of sleeve to improve the trans portability of developer, leading to a decrease in the conveyed amount of developer. In contrast, according to the image forming method of the present invention, since a sleeveless magnet roller is used, none of such disadvantages occurs and a good image quality is obtained as shown in the embodiments 1 and 2.

In the control 2 of the table 3, the estimation of images was performed using one-component developer comprising

TABLE 3

| | | | | | Applied voltage | | | | |
|---|---|---|---|---|---|---|---|---|---|
| | | Gap | | Direct | Alternating current | | Image quality | | |
| | Developer | Dg | Ds | current | AC | | 5K page | | |
| Control | Toner | (mm) | (mm) | DC (V) | ($V_{p-p}$) | Hz | Estimate | Remark | |
| 1 | Magnetic toner (40%) | 0.2 | 0.4 | −400 | 1200 | 200 | x | Image density lowers 1.41 → 1.34 | |
| 2 | Non-magnetic toner | 0 | 0.2 | −500 | 2400 | 1k | x | White stripes appear Fog occur | |

The Table 1 reveals that a sufficient image density is obtained and the concentration of fog is suppressed to a sufficiently low level regardless of whether one-component or two-component developer within the range of Dg=0 to 0.3 mm and Ds–Dg=0.1 to 0.3 mm. Furthermore, it is found in two-component developer that a combination of carrier with magnetic toner provides a good result as shown above independently of the kind of carrier (three kinds of carrier comprising representative ferrite, magnetite, and flat iron powder are used).

And it is also found that a sufficiently good image quality is obtained by a combination of non-magnetic toner with flat-shaped iron carrier.

non-magnetic toner with a urethane rubber roller in which no magnetic powder is mixed provided as the developing roller. At that time, fog was perceived for ordinary image forming and the appearance of white stripes is found in a series of 5000 sheet printing. The reason for the above fog is that use of an insulating developing roller compels developer to be insufficiently triboelectrostatic charged, thereby allowing developer to be scattered from the development roller. In addition, in the comparative example 2, the doctor blade is kept in contact with the developing roller for obtaining triboelectrostatic charge and accordingly it is considered that the portion of toner insufficiently triboelectrostatic charged that cannot be completely adsorbed to the developing roller is apt to stick fast to the doctor blade in a form of lump, thereby leading to the appearance of white stripes in a series of 5000 sheet printing.

In contrast to this, because of mixing magnetic powder into resin for the magnetic adsorption of developer to the development roller, the present invention can prevent not only the scattering of the above developer effectively but also the fast sticking to the doctor blade, so that a good image quality is obtained as shown in the embodiments 1 and 2.

From these, by using a low-forming-cost resin for cost-saving and downsizing as well as by complementing an insufficient triboelectrostatic charge of resin-used developer with magnetically attraction force due to the kneading of magnetic powder, and further by setting Ds and Dg within a predetermined range, the effectiveness of the image forming method according to the present invention in preventing the background fog and other disadvantage has been confirmed.

In an image forming method according to the present invention, a low-cost downsizing can be achieved by using a sleeveless magnetic roller made of an easy-formability material composed of at least resin and magnetic powder for a developer conveying member. Furthermore, scattering of a developer attributed to an incomplete triboelectrostatic charge by use of resin is prevented by using a magnetic attraction through kneading of magnetic powder into resin, so that a good image quality free from background fog can be obtained.

Also, because of magnetically attracting a developer thereon, the sleeveless magnet roller differs from a conventional sleeve magnet roller treated with shot blasting and can perform an image forming without affected by a change in fluidity dependent on the using environment of a developer.

Furthermore, using a non-contact development prevents a developer from being unnecessarily deposited to a non-image area of a latent image due to the rubbing of a developer and removes the developer deposited on a non-image area of a latent image under a superposed application of DC and AC bias voltages, thereby enabling a good image quality with a suppressed background fog to be obtained.

Still further, currently used general one-component developers (magnetic toner) and two-component developers (regardless of whether magnetic toner or non-magnetic toner), including color toner, can be used for developer as it is, which application enables an improvement in image quality and the low-cost downsizing of a copier to be further forwarded without a great modification in the basic constitution of a developing device.

We claim:

1. An image forming method comprising the steps of:

placing a developer conveying member opposite an image-bearing member to form a developing region;

regulating a thickness of a layer of a magnetic developer held on a surface of the developer conveying member with a thickness regulating member disposed opposite the developer conveying member;

conveying the magnetic developer held on the surface of the developer conveying member to the developing region; and applying a developing bias voltage to the developing region to visualize an electrostatic latent image on the developing region, wherein the magnetic developer comprises a magnetic toner and a magnetic carrier, the magnetic toner having a concentration of 10 to 90 wt %;

wherein the magnetic toner includes 20 to 60 wt % of magnetic powder and has a volume resistivity above $10^{13}$ Ω·cm, a triboelectrostatic charge above 5 μc/g in absolute value, and an average particle size of 5 to 10 μm, wherein the developer conveying member includes a cylindrical permanent magnet having at least 50 to 95 wt % of magnetic powder and resin and having a plurality of magnetic poles with heteropolar magnetic poles alternately disposed in a circumferential direction on the surface of the developer conveying member, wherein the developer conveying member is placed opposite the image-bearing member through a developing gap (Ds), Ds being larger than the thickness of the magnetic developer layer regulated by the thickness regulating member, Dg=0 to 0.4 (mm), and Ds–Dg=0.1 to 0.3 (mm), where Dg is a doctor gap between the thickness regulating member and the surface of the developer conveying member, and wherein the developing bias voltage includes an AC bias voltage superimposed on a DC bias voltage.

2. The image forming method as set forth in claim 1, wherein the DC bias voltage is −200 to −600V and wherein the AC bias voltage is 200 to 2400V peak-to-peak at 100 Hz to 20 KHz.

3. The image forming method as set forth in claim 1, wherein the magnetic toner further includes less than 1 wt % of a fluidizer.

4. The image forming method as set forth in claim 1, wherein the magnetic toner has a concentration of 10 to 60 wt %.

5. The image forming method as set forth in claim 1, wherein the magnetic carrier has an average particle size of 5 to 100 μm and a magnetization of more than 50 emu/g in a magnetic field of 1000 Oe.

6. The image forming method as set forth in claim 1, wherein the magnetic toner includes a binder resin and a colorant.

7. The image forming method of claim 1, wherein the cylindrical permanent magnet is a cylindrical isotropic permanent magnet.

8. An image forming method comprising the steps of:

placing a developer conveying member opposite an image-bearing member to form a developing region;

regulating a thickness of a layer of a magnetic developer held on a surface of the developer conveying member with a thickness regulating member disposed opposite the developer conveying member;

conveying the magnetic developer held on the surface of the developer conveying member to the developing region; and applying a developing bias voltage to the developing region to visualize an electrostatic latent image on the developing region, wherein the magnetic developer comprises a non-magnetic toner and a magnetic carrier, the non-magnetic toner including a binder resin and a colorant and having a concentration of 5 to 60 wt % and the magnetic carrier having an average particle size of 5 to 100 μm and a magnetization of more than 50 emu/g in a magnetic field of 1000 Oe, wherein the non-magnetic toner has a volume resistivity above $10^{13}$ Ω·cm, a triboelectrostatic charge above 5 μ c/g in absolute value, and an average particle size of 5 to 10 μm, wherein the developer conveying member includes a cylindrical permanent magnet having at least 50 to 95 wt % of magnetic powder and resin and having a plurality of magnetic poles with heteropolar magnetic poles alternately disposed in a circumferential direction on the surface of the developer conveying member, wherein the developer conveying member is placed opposite the image-bearing member through a developing gap (Ds), Ds being larger than the thickness of the magnetic developer layer regulated by the thickness regulating member, Dg=0 to 0.4 (mm), and Ds–Dg=0.1 to 0.3 (mm), where Dg is a doctor gap between the thickness regulating member and the surface of the developer conveying member, wherein the developing bias voltage includes an AC bias voltage superimposed on a DC bias voltage.

9. The image forming method of claim 8, wherein the cylindrical permanent magnet is a cylindrical isotropic permanent magnet.

* * * * *